US010737853B2

(12) United States Patent
Giraud et al.

(10) Patent No.: US 10,737,853 B2
(45) Date of Patent: Aug. 11, 2020

(54) CONTAINER WITH CHILD RESISTANT CLOSURE AND METHODS OF MAKING THE SAME

(71) Applicant: CSP TECHNOLOGIES, INC., Auburn, AL (US)

(72) Inventors: Jean-Pierre Giraud, Auburn, AL (US); Herve Pichot, Chennevieres-sur-Marne (FR); Franklin Lee Lucas, Jr., Opelika, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 71 days.

(21) Appl. No.: 16/077,675

(22) PCT Filed: Feb. 10, 2017

(86) PCT No.: PCT/US2017/017298

§ 371 (c)(1),
(2) Date: Aug. 13, 2018

(87) PCT Pub. No.: WO2017/139529

PCT Pub. Date: Aug. 17, 2017

(65) Prior Publication Data

US 2019/0047755 A1 Feb. 14, 2019

Related U.S. Application Data

(60) Provisional application No. 62/294,486, filed on Feb. 12, 2016.

(51) Int. Cl.

| | |
|---|---|
| ***B65D 50/04*** | (2006.01) |
| ***B65D 43/16*** | (2006.01) |
| ***A61J 1/03*** | (2006.01) |

(52) U.S. Cl.
CPC ..... *B65D 50/045* (2013.01); *A61J 1/03* (2013.01); *B65D 43/162* (2013.01);
(Continued)

(58) Field of Classification Search
CPC ..... B65D 50/045; B65D 43/162; B65D 2543/00296; B65D 2543/00842;
(Continued)

(56) References Cited

U.S. PATENT DOCUMENTS

| | | | | |
|---|---|---|---|---|
| 3,667,637 | A | 6/1972 | Bagguley et al. | |
| 3,790,015 | A * | 2/1974 | Imamura ..... | B65D 50/045 215/209 |

(Continued)

FOREIGN PATENT DOCUMENTS

| | | | |
|---|---|---|---|
| EP | 0379775 | A1 | 8/1990 |
| EP | 1260451 | A1 | 11/2002 |
| WO | 2014204890 | A1 | 12/2014 |

OTHER PUBLICATIONS

International Search Report and Written Opinion issued in PCT/US2017/017298, dated Mar. 29, 2017.

*Primary Examiner* — Kareen K Thomas
(74) *Attorney, Agent, or Firm* — Mark T. Vogelbacker; Eckert Seamans Cherin & Mellott, LLC

(57) ABSTRACT

A container (20) includes a body (22) defining an interior and an opening (32) that leads to the interior. A cap (24) is removably affixed over the opening and is movable between a closed position and an opened position. The cap includes a front tab (52) having an undersurface (54). A child resistant closure in the form of a guard (56) having a depressible wall (58) is located on the body and is movable between an engaged position and a disengaged position. When in the engaged position the guard covers the undersurface of the front tab to prevent the cap from being moved to the opened
(Continued)

position. When in the disengaged position the undersurface of the front tab is exposed, enabling the cap to be moved to the opened position.

23 Claims, 2 Drawing Sheets

(52) U.S. Cl.
CPC .... *B65D 2215/02* (2013.01); *B65D 2251/105* (2013.01); *B65D 2543/00092* (2013.01); *B65D 2543/00296* (2013.01); *B65D 2543/00527* (2013.01); *B65D 2543/00537* (2013.01); *B65D 2543/00629* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 2543/00796; B65D 2543/00731; B65D 2543/00685; B65D 2543/00629; B65D 2543/00537; B65D 2543/00527; B65D 2543/00092; B65D 2251/105; B65D 2215/02; A61J 1/03
USPC ..... 220/780, 793, 269, 263, 283, 836, 840, 220/841, 842, 810; 215/235, 237
See application file for complete search history.

(56) References Cited

U.S. PATENT DOCUMENTS

| | | | | | |
|---|---|---|---|---|---|
| 4,042,105 | A * | 8/1977 | Taylor | B65D 50/045 | 206/1.5 |
| 4,244,495 | A * | 1/1981 | Lorscheid | B65D 47/0819 | 222/153.14 |
| 4,444,326 | A | 4/1984 | Musel | | |
| 4,723,669 | A | 2/1988 | Barriac | | |
| 4,783,056 | A | 11/1988 | Abrams | | |
| 5,180,072 | A * | 1/1993 | Oehlert | B65D 47/0842 | 206/1.5 |
| 5,723,085 | A | 3/1998 | Abrams et al. | | |
| 5,765,705 | A * | 6/1998 | Deubel | B65D 50/045 | 215/216 |
| 5,860,543 | A * | 1/1999 | Decelles | B65D 47/0838 | 215/209 |
| 6,303,064 | B1 | 10/2001 | Abrams et al. | | |
| 6,769,558 | B1 | 8/2004 | Bucholtz | | |
| 7,798,348 | B2 * | 9/2010 | Sawyer | B65D 50/046 | 215/237 |
| 8,528,778 | B2 | 9/2013 | Giraud | | |
| 2002/0175137 | A1 | 11/2002 | Rousselet | | |
| 2011/0127269 | A1 | 6/2011 | Bucholtz et al. | | |
| 2015/0368003 | A1 | 12/2015 | Freedman et al. | | |

* cited by examiner

Fig. 4
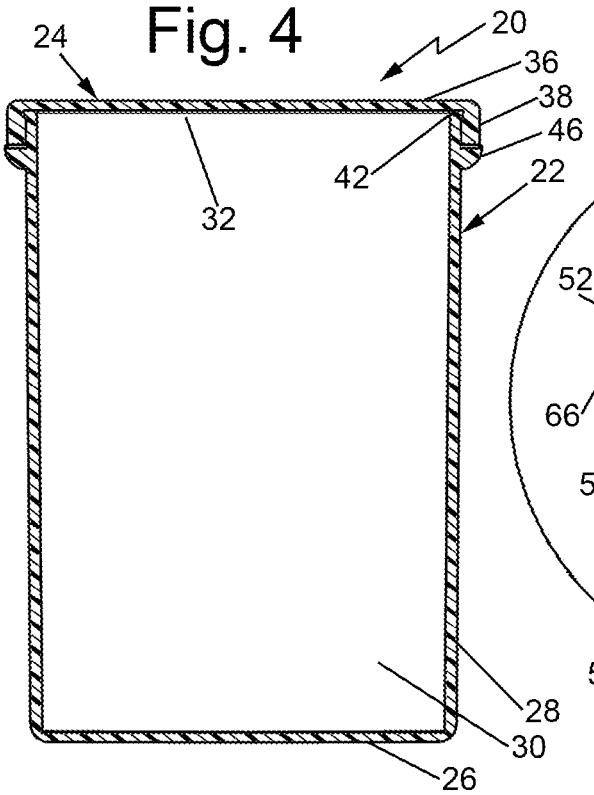
Fig. 5
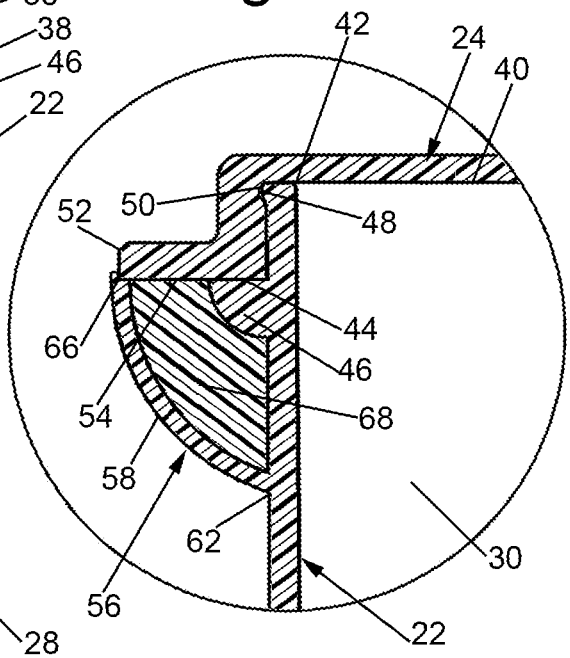
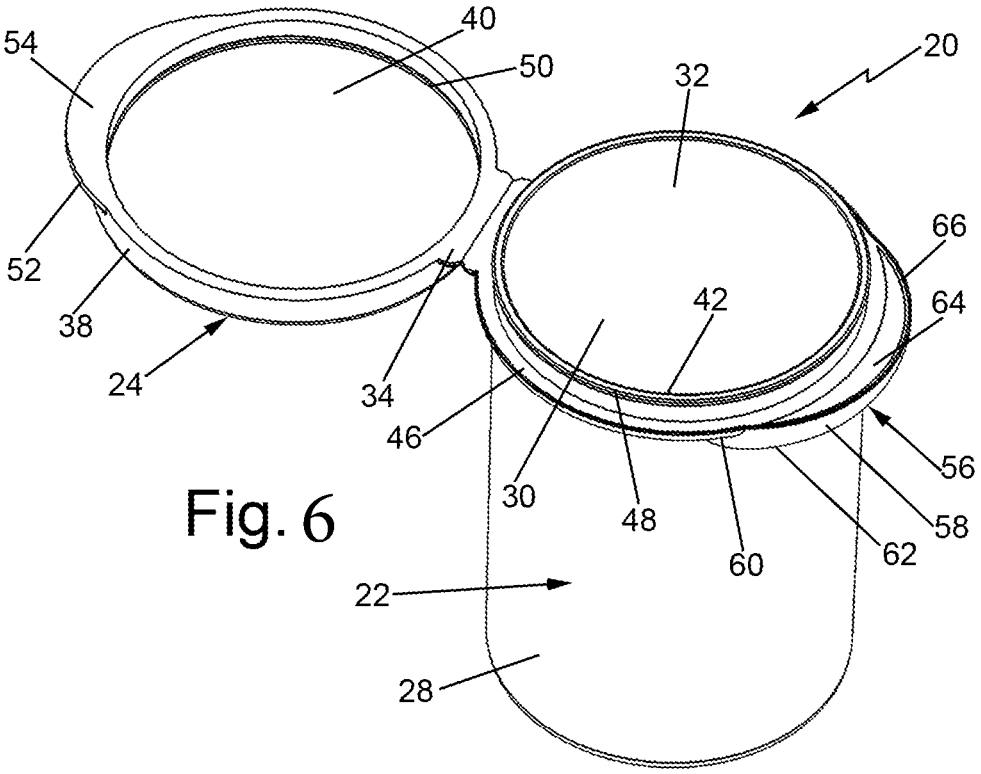
Fig. 6

CONTAINER WITH CHILD RESISTANT CLOSURE AND METHODS OF MAKING THE SAME

CROSS-REFERENCE TO RELATED APPLICATIONS

This application is a U.S. National Phase of International Application No. PCT/US2017/017298 filed Feb. 10, 2017, which claims priority to U.S. Provisional Patent Application No. 62/294,486 filed Feb. 12, 2016, which are incorporated herein by reference in their entirety.

FIELD OF INVENTION

The invention relates general to containers, and more specifically to containers having child resistant closures and methods of making the same.

BACKGROUND

Product packaging can be used to enhance products with features such as environmental protection, protection from being damaged and child resistance protection. Ideally, such packaging is provided in a way that is easy and convenient for the consumer using the product.

One common form of product packaging is a vial, which typically includes a body portion, an opening formed at the top thereof and removable lid for covering the opening. The lid may be attached to the body portion by a hinge. Typically, the entire product is exposed when the package is opened. If the product needs to be protected from the environment, for example humidity, then a seal is required. If the product is not suited for children, then a way of providing child resistance is needed. A need exists for a simple design for child-resistant packaging that is sleek in appearance, does not require assembly of separate components (except perhaps a cap, in some circumstances) and is not easily circumvented using tools (e.g. a pencil) to pry open.

SUMMARY OF THE INVENTION

In accordance one aspect of this invention there is provided a container comprising a body, a cap and a child resistant closure. The body has a tubular side wall, an interior and an opening in communication with the interior. The cap is configured for removable positioning over the opening between an opened position and a closed position, and vice versa. The cap has a side wall including a front tab. The front tab has an undersurface. The child resistant closure comprises a guard having a wall portion including a pair of side edges and a bottom edge. Each of the side edges of the wall portion merges with a respective portion of the side wall of the body in a respective continuous unbroken joint. The bottom edge of the wall portion also merges with the side wall of the body in a continuous unbroken joint. The wall portion is movable between an engaged position and a disengaged position, and vice versa. The wall portion is normally in the engaged position wherein it extends outward from the side wall of the body adjacent to the opening to cover and hide the undersurface of the front tab when the cap is in the closed position. The wall portion of the guard, when in the disengaged position, exposes the undersurface of the front tab to enable a user to press on the undersurface of the front tab to cause the cap to move to its opened position.

In accordance with one preferred embodiment of the container of this invention, the wall portion of the guard is somewhat flexible so that it can be pressed inward toward the side wall of the body from its normal engaged position to its disengaged position. The cap is configured for snap-fitting over the opening when the cap is in the closed position. When the wall portion of the guard is in the engaged position and the cap is in the closed position the periphery of the side wall of the cap does not extend outward beyond the periphery of the side wall of the body.

In accordance with another aspect of this invention there is provided a method of making a container with a child resistant closure. The method comprises molding the body of the container and molding the child resistant closure (which can be optionally in a single step). The body has a tubular side wall, an interior and an opening in communication with the interior. The child resistant closure comprises a guard having a wall portion including a pair of side edges and a bottom edge. Each of the side edges of the wall portion merges with a respective portion of the side wall of the body in a respective continuous unbroken joint. The bottom edge of the wall portion also merges with the side wall of the body in a continuous unbroken joint. The wall portion is movable between an engaged position and a disengaged position, and vice versa. The cap is also molded and is configured for removable positioning over the opening between an opened position and a closed position, and vice versa. The cap has a side wall including a front tab. The front tab has an undersurface. The cap is coupled to the body wherein the wall portion is normally in the engaged position, whereupon it extends outward from the side wall of the body adjacent to the opening to cover and hide the undersurface of the front tab when the cap is in the closed position.

In accordance with one preferred method of this invention, the body and the cap are molded as an integral unit, with the cap being connected to the body by a living hinge and with the wall portion of the guard being somewhat flexible so that it can be pressed inward toward the side wall of the body from its normal engaged position to its disengaged position. The guard may comprise a cavity contiguous with the wall portion and which can either be hollow or be filled. In any embodiment, the wall portion of the guard is flexible so that it can be pressed radially inward toward the side wall of the body from its normal engaged position to its disengaged position. Optionally, in any embodiment, the wall portion of the guard is resilient such that it is configured to automatically return from its disengaged position to its normal engaged position upon removal of inward radial pressure on the wall portion of the guard. Optionally, in any embodiment, the container is made from a blend of thermoplastic polymer and thermoplastic elastomer, wherein the thermoplastic polymer is optionally polypropylene and/or polyethylene and wherein the blend has at least 70% thermoplastic polymer, optionally least 80% thermoplastic polymer, optionally at least 90% thermoplastic polymer.

BRIEF DESCRIPTION OF THE DRAWINGS

FIG. 4 is an enlarged vertical sectional view taken along line 4-4 of FIG. 1;

FIG. 5 is an enlarged sectional view, similar to that of FIG. 3, but showing an alternative embodiment of a child resistant container constructed in accordance with this invention; and FIG. 6 is an enlarged isometric view of the exemplary container shown in FIG. 1, but showing the container in its opened state.

DETAILED DESCRIPTION OF THE PREFERRED EMBODIMENTS

Figure 1:
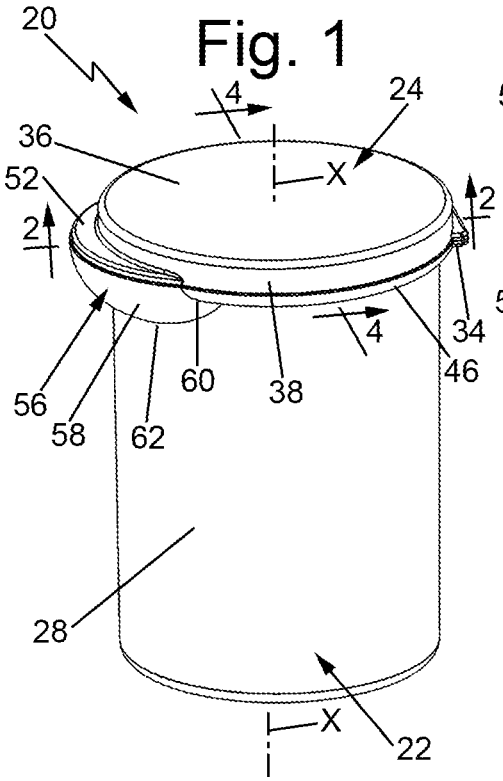
FIG. 1 is an isometric view of one exemplary child resistant container constructed in accordance with this invention, with the container being shown in its closed state.
Figure 2:
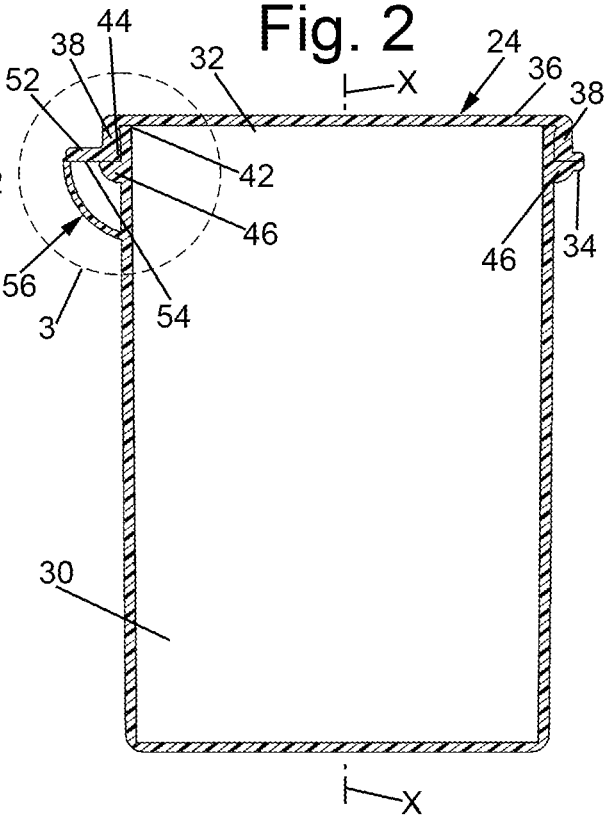
FIG. 2 is an enlarged vertical sectional view taken along line 2-2 of FIG. 1.

Detailed embodiments of the present invention are disclosed herein, but it should be understood that the disclosed embodiments are merely exemplary of the invention, which may be embodied in various forms. The figures are not necessarily to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

An exemplary container 20 according to the invention is shown in FIGS. 1 and 5. In the embodiment shown in those figures, the container 20 is in the form of a vial, although it could take various other forms, e.g., a bottle, cartridge, case, box, etc. In any case the container 20 includes a body 22 and a lid or cap 24. The body 22 is a somewhat elongated, hollow member having a central longitudinal axis X and includes a base wall 26 and a tubular side wall 28 extending about the periphery of the base wall and about the axis X. The side wall 28 extends upward from the base wall 26 and together with the base wall defines a hollow interior or cavity 30 (FIGS. 2-5) suitable for housing a plurality of products of any type, e.g., pills, capsules, etc. In the illustrated embodiment, the base wall 26 is of a circular shape and the side wall 28 has a corresponding circular tubular cross section. It should be noted that the container body 22 could take on other shapes as well, e.g., elliptical, rectangular, square, triangular, or any other regular or irregular shape. Moreover, the height and diameter of the body can be of any dimension desired for a particular application.

As best seen in FIG. 5, the body 22 includes an opening or mouth 32 defined by the upper edge of the side wall 28 and leading to the interior cavity 30. The cap 24 is configured to be removably affixed or secured over the container's mouth 32 to close off the cavity 30 when the cap is in its closed position like shown in FIGS. 1-4. To that end, the cap is a movable member which is configured to be moved from the closed position or state to an opened position or state, and vice versa. In the closed position, like shown in FIG. 1, the cap covers and closes the mouth 32. When the cap is in the opened position, like shown in FIG. 5, the interior cavity 30 of the container is accessible to a user via the exposed mouth 32. In the exemplary embodiment the cap is pivotably connected to the body via a hinge 34 (to be described later). Thus, the cap can be pivoted between the closed position and the opened position, and vice versa. It should be pointed out that if desired the cap need not be connected to the body by a hinge, but may be connected to it by some other member that enables the cap to be moved to either the closed or opened position when desired. In fact, it is contemplated that the cap need not be physically connected to the body at all, but can be a separate component.

The cap 24 basically comprises a base portion 36 from which an annular skirt or side wall 38 depends downward about the outer perimeter or periphery of the base portion. In the exemplary embodiment shown the cap is a disk-like member having a generally planar, circularly shaped, base portion 36. That configuration is merely exemplary. Thus, the cap may be of other shapes than that shown. For example, the base portion 36 may be convex or domed and the outer surface of the skirt 38 may be curved to form a continuous surface with the outer surface of the base portion. Alternatively, the cap may have only a base portion without a skirt. In any case, in the optional embodiment shown, the base portion 36 and the skirt 38 together define a recess 40 (FIG. 5) in the underside of the cap. The recess 40 is configured to tightly receive the upper edge 42 of the container's side wall 28 as clearly shown in FIG. 3 when the cap is in the closed position or state. Moreover, when the cap is in that state, the lower edge 44 of the skirt 38 tightly engages the top planar surface of an annular ledge 46. The ledge 46 extends about the periphery of the container's side wall 28 closely adjacent its upper edge 42. Alternative configurations for providing a seal, e.g., a moisture tight seal between the cap and the body may be used according to optional embodiments. For example, optional embodiments of the present invention may utilize sealing configurations between cap and body and methods for making the same, according to U.S. Pat. Nos. 4,783,056, 5,723,085, 6,303,064, 6,769,558, 8,528,778, and U.S. Pat. Pub. Nos. 2011/0127269 and 2015/0368003, all of which are incorporated herein by reference in their entireties.

The outer surface of the tubular side wall 28 immediately adjacent its upper edge 42 includes an annular bulbous projection 48 extending about the periphery of the side wall. The recess 40 of the cap 24 includes an annular groove 50 immediately adjacent the point at which the skirt 38 merges with the base portion 36 of the cap. The groove 50 is of a complementary shape to the shape of the annular projection 48 and is of a sufficient size so that when the cap is in its closed state, the annular projection 48 snap-fits within the annular groove 50. This action releasably secures the cap over the mouth 32 of the container, whereupon the cap will be is in its closed position and resistant to accidental disconnection. However, as will be described shortly, that connection can be overcome to enable the cap to be manually moved by a user to the opened position when such action is desired.

The snap-fitting of the cap over the mouth of the container as described above results in a good moisture-tight seal therebetween. As used herein, the term "moisture-tight" is defined as having a moisture ingress (after three days) of less than 1500 micrograms of water, determined by the following test method: (a) place one gram plus or minus 0.25 grams of molecular sieve in the container and record the weight; (b) fully close the container; (c) place the closed container in an environmental chamber at conditions of 80% relative humidity and 72° F.; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

The hinge 34 extends between the skirt 38 and the upper edge 42 of the container's side wall 28 to pivotally join the cap to the container's body 22. In the illustrated embodiment, the hinge 34 is of the living hinge type, i.e., is formed integrally with the body 22 and cap 24, for example by co-molding or simply being formed as a continuation of the material of the body and cap. This can be achieved, for example, by injection molding the body and cap together, such that they are joined by a section of material thin enough to permit folding, and in turn pivoting between the body and the cap. In other embodiments, the body and the cap may be molded separately and linked together by the hinge.

As mentioned above, the container 20 includes a child resistant feature. That feature is in the form of a closure that prevents a child from opening the container by moving, e.g., pivoting, the cap from the closed position to the opened position when the closure is in its "engaged" state (to be described below), while enabling the cap to be moved to its opened position when the closure is in its "disengaged" state (also to be described below). The child resistant closure basically comprises a tab 52 forming a portion of the cap 24 and a guard 56 forming a portion of the container's body 22. In the exemplary embodiment shown in FIGS. 1 and 5, the tab 52 is a generally planar, crescent-shaped member which projects outward from the lower edge 44 of the cap's skirt 38 at the front of the cap, i.e., located opposite to the hinge 34. The tab 54 includes an undersurface 54 that is configured to be covered or hidden by the guard 56, when the guard is in its engaged state and to be uncovered or exposed when the guard is in its disengaged state. When the guard is in it disengaged state, a user can press on the exposed undersurface 54 of the tab 52 to pivot the tab about the hinge 34 from its closed position to its opened position.

Figure 3:
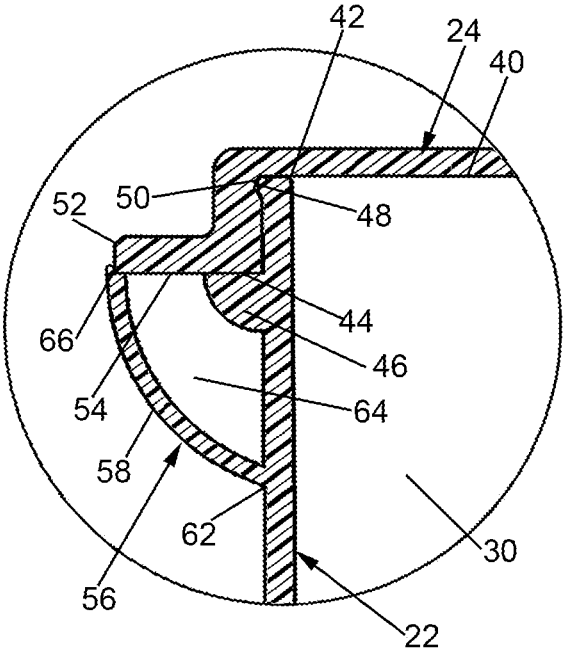
FIG. 3 is an enlarged sectional view of the portion of the container shown within the circle designated by the reference number 3 in FIG. 2.

Turning now to FIGS. 1 and 3, it can be seen that the guard 56 basically comprises a hollow projection in the form of a curved front wall portion 58 shaped somewhat like a kangaroo pouch and extending outward from the front of the container's body adjacent its mouth 32. That front wall portion 58 has a pair of side edges 60 (only one of which can be seen in FIG. 1) and a bottom edge 62. Each side edge 60 of the front wall portion merges with a respective portion of the annular ledge 46 and a contiguous respective portion of the side wall 28 of the body 22 in a respective continuous or unbroken joint. In a similar manner, the bottom edge 62 of the front wall portion also merges with the side wall 28 of the tubular body in a continuous unbroken joint. Thus, the guard 56 is affixed to (preferably integrally molded with) the outer surface of the side wall 28 along the entire periphery of the guard, without any gap or break therebetween, except for the top edge of the front wall portion of the guard which is spaced from the top edge 42 of the container's side wall 28 by a cavity 64. Moreover, the top edge of the guard 56 includes a small ledge or recess 66 flush with the top surface of the annular ledge 46. The guard 56, and preferably the container 20 generally is constructed of an injection molded thermoplastic, e.g., polypropylene and/or polyethylene.

When the cap is in its closed state, its tab 52 covers the cavity 64 in the guard, with the undersurface 54 of the tab at its periphery resting within the small ledge 66 in the front wall portion 58 of the guard, while the lower edge of the cap's skirt 38 tightly engages the top of the annular ledge 46. Accordingly, no space or gap is provided between the cap and the container's body into which some implement can be inserted from the underside to pry the cap open. Furthermore, the outer periphery of the cap's skirt 38 does not extend outward beyond the outer periphery of the ledge 46. In fact, in the disclosed embodiments, the outer periphery of the skirt is flush with the outer periphery of the ledge 46. As such there is no overhang of any portion of the cap which could be pressed upward to open the cap when the cap is in its closed state. Moreover, the curved nature of the guard and the fact that it merges with the container body along the entire periphery of the guard except for its top edge, which is covered by the cap's tab, when the cap is closed, minimizes the chances that something will get caught on the guard when the container is located in a person's pocket, hand bag, etc.

The front wall portion 58 of the guard is configured to be flexible so that it can be resiliently flexed or otherwise moved inward from its normal engaged position, like shown in FIGS. 1 and 5, to its disengaged position (not shown) by a user pressing inward on the guard toward the central axis X. That action resiliently collapses the guard's cavity somewhat so that the front wall portion 58 will be located closer to the central axis X than in its normal, engaged position. Thus, when the cap 24 is in its closed position and the guard is in its engaged position, like shown in FIGS. 1-3, the periphery of the tab 52 will be located within the recess 66 of the front wall portion 58 of the guard so that the undersurface of the tab is covered and hidden. As such there will be no exposed undersurface portion of the tab which can be engaged, e.g., by a user's finger or a pencil to be pushed upward to open the cap. Thus, the guard prevents opening of the container by individuals who should not have access to its contents, such as children, when the guard is in the engaged position. Conversely, when the front wall portion 58 of the guard is pressed inward, that action will uncover or expose a portion of the undersurface 54 of the tab 52 closest to its edge, whereupon a user can press upward on that exposed undersurface portion to release the snap-fit connection of the annular projection 48 within the annular groove 50, thereby pivoting the cap upward to its opened position. It should be appreciated by those skilled in the art that the natural bias of the front wall portion of the guard is resilient and will thus automatically return the guard from its disengaged position to its engaged position, when the pressure on its front wall portion 58 is released.

In FIG. 6 there is shown an alternative embodiment of this invention. That embodiment is identical in construction to the embodiment of FIGS. 1-3, except that it makes use of an elastomeric material 68 filler in the cavity 64. Thus, in the interest of brevity the common features of the embodiments of FIGS. 1 and 6, will be given the same reference numbers and the details of the construction and operation of those features will not be reiterated.

Still another alternative embodiment of the invention may include a guard 56 that is solid-bodied, i.e., doesn't include a cavity 64 (whether filled or unfilled), providing that the solid-bodied guard is formed of a material that can be collapsed upon the application of pressure to it, and which will assume its un-collapsed state when that pressure is removed.

In accordance with one preferred method aspect of this invention, the entire container including the body, cap and guard is formed as an integral unit. This can be achieved, for example, by injection molding the entire container 20 as an integral unit of any suitable material, e.g., polypropylene, with the thickness of the front wall portion 58 of the guard being such that it can be flexed inward by the application of modest pressure onto it. In other embodiments, the projection 56 could be a separate mechanical element which is flexible and which is affixed to the side wall 28 of the body by some means, e.g., a weld, an adhesive, etc. The embodiment of the container shown in FIG. 6 can be formed by a co-molding process, with the container 20 being formed in one shot, and then the cavity 64 filled with an elastomeric material 68 in another shot. It is also contemplated that an embodiment of the container can be formed making use of either a solid bodied guard or a hollow bodied guard by injection molding the container of a mixture of blended materials, e.g., 80% polypropylene and 20% of a thermoplastic elastomer (TPE). Irrespective of the manner in which the container is made, the guard should be such that it is affixed to the container body in a manner such that there is no gap between the guard and the container body into which some implement can be inserted to pry the cap open.

While the preferred embodiments of the invention and the methods of making them have been described in detail above, the invention is not limited to the specific embodiments and method of making them as described, which should be considered as merely exemplary.

What is claimed is:

1. A container comprising a body, a cap, and a child resistant closure, the body having a tubular side wall containing an annular bulbous projection extending about a periphery of the side wall immediately adjacent an upper edge of the body, an interior, and an opening in communication with the interior, the cap being configured for removable positioning over the opening between an opened position and a closed position, the cap having a base portion and a skirt depending from the base portion, the skirt including an annular groove configured to snap-fit with the annular bulbous projection of the side wall when the cap is in the closed position, the skirt further configured to engage a top planar surface of an annular ledge extending around the periphery of the body, the cap further including a front tab extending radially outward from the cap, the front tab having an undersurface, the child resistant closure comprising a guard having a curved wall portion extending outwardly from the body, the wall portion of the guard including a pair of side edges and a bottom edge, each of the side edges of the wall portion merging with the side wall of the body in a continuous joint, the bottom edge of the wall portion merging with the side wall of the body in a continuous unbroken joint, the wall portion being movable between an engaged position and a disengaged position, the wall portion being normally biased in the engaged position wherein the wall portion extends outward from the side wall of the body adjacent to the opening to cover and hide the undersurface of the front tab when the cap is in the closed position, the wall portion of the guard when in the disengaged position exposing the undersurface of the front tab to enable a user to press on the undersurface of the front tab to cause the cap to move to its opened position.

2. The container of claim 1, wherein the wall portion of the guard is flexible so that it can be pressed radially inward toward the side wall of the body from its normal engaged position to its disengaged position.

3. The container of claim 1, wherein the wall portion of the guard is resilient such that it is configured to automatically return from its disengaged position to its normal engaged position upon removal of inward radial pressure on the wall portion of the guard.

4. The container of claim 1, wherein the guard comprises a cavity contiguous with the wall portion.

5. The container of claim 4, wherein the cavity is filled with an elastomeric material.

6. The container of claim 1, wherein the container comprises an injection moldable thermoplastic material, optionally polypropylene and/or polyethylene.

7. The container of claim 1, wherein the cap is pivotally secured to the body by a hinge.

8. A method for opening the container of claim 1, the method comprising applying inward radial pressure onto the wall portion of the guard to move the wall portion of the guard from the engaged position to the disengaged position and then pressing the exposed undersurface of the front tab upward to move the cap from its closed position to its opened position and disengaging the snap-fit connection between the annular projection with the annular groove.

9. The method of claim 8, further comprising releasing the inward radial pressure from the wall portion of the guard whereupon the wall portion of the guard automatically returns to the engaged position.

10. The method of claim 8, where the container is made from a blend of thermoplastic polymer and thermoplastic elastomer, wherein the blend has at least 70% thermoplastic polymer.

11. The container of claim 1, wherein the container is made from a blend of thermoplastic polymer and thermoplastic elastomer, wherein the blend has at least 70% thermoplastic polymer.

12. A method of making a container with a child resistant closure, the method comprising:

a) molding a body of the container and a child resistant closure, the body having a tubular side wall, an interior and an opening in communication with the interior, the child resistant closure comprising a guard having a curved wall portion extending outwardly from the body, the wall portion including a pair of side edges and a bottom edge, each of the side edges of the wall portion merging with a portion of the side wall of the body in a continuous joint, the bottom edge of the wall portion merging with the side wall of the body in a continuous unbroken joint, the wall portion being movable between an engaged position and a disengaged position;

b) molding a cap configured for removable affixing over the opening between an opened position and a closed position, the cap having a base portion and a skirt depending from the base portion about an outer periphery of the skirt, the cap further including a front tab extending radially outward from the cap at an end of the skirt opposite the base, the front tab having an undersurface; and c) coupling the cap to the body by a hinge, wherein the wall portion is normally in the engaged position whereupon the wall portion extends outward from the side wall of the body adjacent to the opening to completely cover and hide the undersurface of the front tab when the cap is in the closed position.

13. The method of claim 12, wherein the body and cap are molded as a unit, integrally coupled by the hinge.

14. The method of claim 12, wherein the body and cap are molded separately and are coupled together by the hinge in an assembling step.

15. The method of claim 12, wherein the wall portion of the guard is flexible so that it can be pressed radially inward toward the side wall of the body from its normal engaged position to its disengaged position.

16. The method of claim 15, wherein the wall portion of the guard is resilient such that it is configured to automatically return from its disengaged position to its normal engaged position upon removal of inward radial pressure on the wall portion of the guard.

17. The method of claim 12, wherein the method further comprises filling the cavity with an elastomeric material.

18. The method of claim 17, wherein the molding of the body and the filling of the cavity with an elastomeric material is accomplished by a co-molding process.

19. The method of claim 12, wherein the container is made from a blend of thermoplastic polymer and thermoplastic elastomer, wherein the blend has at least 70% thermoplastic polymer.

20. A container comprising:

a body having a tubular side wall, an interior, and an opening in communication with the interior;

a cap configured for removable positioning over the opening between an opened position and a closed position, the cap having a base portion, a skirt depending from an outer periphery of the base portion, and a front tab extending radially outward from the cap from an end of the skirt opposite the base portion, the front tab having an undersurface; and a child resistant closure including a guard having a curved wall portion extending outwardly from the body, the wall portion being movable between an engaged position and a disengaged position, the wall portion being normally biased in the engaged position wherein the wall portion extends outwardly from the side wall of the body adjacent to the opening to hide the undersurface of the front tab when the cap is in the closed position, the wall portion of the guard when in the disengaged position exposing the undersurface of the front tab to enable a user to press on the undersurface of the front tab to cause the cap to move to its opened position.

21. The container of claim 20, wherein the body further includes an annular bulbous projection extending about a periphery thereof immediately adjacent an upper edge of the body, and wherein the skirt includes an annular groove configured to snap-fit with the annular bulbous projection of the body when the cap is in the closed position.

22. The container of claim 20, wherein the body includes an annular ledge extending outwardly from the periphery of the body, and wherein the skirt is configured to engage a top planar surface of the annular ledge when the cap is in the closed position.

23. The container of claim 20, wherein a cavity formed by the curved wall portion of the guard is filled with an elastomeric material.

* * * * *